US010953338B1

(12) United States Patent
Herren

(10) Patent No.: US 10,953,338 B1
(45) Date of Patent: Mar. 23, 2021

(54) BALLOON TYING STATION

(71) Applicant: Gerald R. Herren, Cookeville, TN (US)

(72) Inventor: Gerald R. Herren, Cookeville, TN (US)

( * ) Notice: Subject to any disclaimer, the term of this patent is extended or adjusted under 35 U.S.C. 154(b) by 73 days.

(21) Appl. No.: 16/124,022

(22) Filed: Sep. 6, 2018

(51) Int. Cl.
*A63H 27/10* (2006.01)

(52) U.S. Cl.
CPC ..... *A63H 27/10* (2013.01); *A63H 2027/105* (2013.01); *A63H 2027/1033* (2013.01); *A63H 2027/1041* (2013.01); *A63H 2027/1083* (2013.01)

(58) Field of Classification Search
CPC ..... A63H 27/10; A63H 2027/1033; A63H 2027/1041; A63H 2027/105; A63H 2027/1083
See application file for complete search history.

(56) References Cited

U.S. PATENT DOCUMENTS 1,008,190 A 11/1911 O'Connell
3,177,021 A 4/1965 Benham
3,572,788 A 3/1971 Cruzan
3,837,691 A 9/1974 Smythe
4,864,762 A 9/1989 Cox
4,989,906 A 2/1991 Peverley
5,016,428 A * 5/1991 Helling ..... A63H 27/10 141/173
5,039,142 A 8/1991 Numa
5,067,301 A * 11/1991 Shore ..... A63H 27/10 53/79
5,305,500 A * 4/1994 Tucker ..... B65D 33/1675 24/30.5 P
5,314,217 A 5/1994 Place
5,568,950 A 10/1996 Herren
5,732,530 A * 3/1998 Pfaff ..... A63H 27/10 24/30.5 W
5,802,677 A * 9/1998 Dorman ..... B65D 33/1675 24/30.5 P
5,820,169 A 10/1998 Butler
6,273,479 B1 8/2001 Carlson
6,813,814 B1 * 11/2004 Schultz ..... A44B 99/00 24/545
6,902,212 B1 6/2005 Mize
7,967,344 B2 6/2011 Herren
(Continued)

OTHER PUBLICATIONS

Herren, Gerald R., Portable Balloon Tying Device, U.S. Appl. No. 15/694,655, filed Sep. 1, 2017.

*Primary Examiner* — Shaun R Hurley
(74) *Attorney, Agent, or Firm* — Baker Donelson; Carl M. Davis, II

(57) ABSTRACT

A balloon tying station for production of a balloon bouquet, having a rack with spaced-apart axles for spools of ribbon for selectively dispensing longitudinally and a balloon tying device having an elongated cantilever extending in the dispensing direction, so that a ribbon being dispensed longitudinally across the cantilever in the dispensing direction underlies a neck portion of a balloon, which neck portion extends stretchingly around the cantilever and looping over and under for pulling off the cantilever and catching the ribbon to tie the knot and secure the ribbon therein, and having a balloon holding device for receiving the ribbon for collecting together a group of balloons.

20 Claims, 6 Drawing Sheets

(56) References Cited

U.S. PATENT DOCUMENTS

| | | | | |
|---|---|---|---|---|
| 8,157,297 | B2 * | 4/2012 | Spilbor | G09B 19/0076 289/17 |
| 9,156,649 | B1 * | 10/2015 | Torosian | B65H 69/04 |
| 2006/0016153 | A1 * | 1/2006 | King | B65B 41/12 53/390 |
| 2008/0121309 | A1 * | 5/2008 | Boise | A63H 27/10 141/313 |
| 2011/0278842 | A1 * | 11/2011 | Spilbor | B65H 69/04 289/13 |
| 2011/0316275 | A1 * | 12/2011 | Wainohu | A63H 27/10 289/2 |
| 2017/0095119 | A1 * | 4/2017 | Losoya | A47J 37/1295 |

* cited by examiner

BALLOON TYING STATION

TECHNICAL FIELD

The present invention relates to an apparatus for inflating balloons and assembly of balloon bouquets. More particularly, the present invention relates to an apparatus for production of inflated knotted balloons, and particularly knotted ribboned balloons each produced by tying a knot in a neck portion of a balloon and selectively having a ribbon secured in the knot, which knotted ribboned balloon may collect in sequence with other knotted ribboned balloons for balloon bouquets.

BACKGROUND OF THE INVENTION

The events services industry provides a wide range of products for parties, celebrations, and event gatherings including table settings, ornaments, center pieces, and other decorative appointments. Casual, party, and promotional events often include decorative balloons for ornamentation. The inflated balloons are used, for example, balloon arches (balloons positioned in a group for an arch), balloon drops (gathered inflated balloons held in an overhead net for release to persons below), balloon releases (gathered floatable balloons inflated with helium and held in a net for simultaneous release), and balloon bouquets having a plurality of helium inflated floating balloons (a number of balloons secured with elongated colorful ribbons to a weighted base).

Balloons inflated with helium float upwardly, and thus are typically secured with colorful elongated ribbons to a weight. The ribbon lengths may vary, such that a plurality of the balloons gathered together form a bunch of colorful balloons. Generally, the balloons are inflated and connected to the ribbon in a manual process. The ribbon is selected from various colors typically supplied as an elongated strand on a spool from which a length is unwound and cut to length. Assembly involves inflating one of the balloons with helium supplied through a gas supply nozzle connected to a helium cylinder, which gas supply nozzle inserts into a neck portion of the balloon. Upon inflating, the balloon is then knotted by tying a knot in the neck portion to prevent escape of the helium through the neck portion. One of several spools of ribbon is selected and a free end tied to the neck portion. The ribbon is pulled and cut to selected length to provide a knotted ribboned balloon. With the colorful elongated ribbon tied to the neck portion, the inflated knotted ribboned balloon floats upwardly to collect in a holding pen suspended or mounted to a ceiling. Holding pens typically have grid-like or fence walls that restrict lateral movement of the balloons from the holding pen. The ribbons hang downwardly, and a balloon bouquet may be assembled by gathering a plurality of the balloons from the holding pen and attaching the distal free ends of the ribbons to a weight.

While such assembly and collecting of knotted ribboned balloons provides balloons that may be selected and gathered together for a balloon bouquet, there remains a need for an improved apparatus to assist the production of inflated balloons knotted with colorful ribbons for collecting together as a bouquet of inflated balloons. It is to such that the present invention is directed.

SUMMARY OF THE INVENTION

The present invention meets the need in the art by providing a balloon tying station that assists the production of inflated balloons knotted with a selected one of a plurality of colorful ribbons for collecting together as a bouquet of inflated balloons. More particularly, the present invention provides a balloon tying station for production of a balloon bouquet, comprising a rack having a pair of spaced apart walls, each wall comprises a first plate and a second adjacent second plate, said first plate having a plurality of spaced-apart slots and each respective slot aligned with a respective slot in the opposing first plate for receiving a respective axle in the aligned slots, said second plate attached outwardly of the first plate to restrict movement of the respective axle outwardly of the slots during use, each axle for receiving a respective spool of ribbon for selectively dispensing a ribbon longitudinally in a dispensing direction, and a support plate projecting from the rack in the dispensing direction. A balloon tying device fixedly seats on the support plate and has an elongated dished cantilever extending from the support plate longitudinally in the dispensing direction. A ribbon being dispensed longitudinally across the support plate and the cantilever in the dispensing direction overlies a neck portion of a balloon that is stretched laterally from a first edge to a second edge of the cantilever. The neck portion further stretches around a side, bottom and opposing side of the cantilever and upwardly to loop (a) over the stretched portion and then (b) under the stretched portion, and being pulled longitudinally in the dispensing direction off of the cantilever to form a knot in the neck portion and secure the ribbon in the knot.

In another aspect, the present invention provides a balloon tying station for production of a balloon bouquet, comprising a rack having a plurality of spaced-apart axles each for receiving a respective spool of ribbon for selectively dispensing a ribbon longitudinally in a dispensing direction and a support plate projecting from the rack in the dispensing direction. A balloon tying device fixedly seats on the support plate and has an elongated dished cantilever extending therefrom, the cantilever defining opposing side walls that each have arcuate distal end portions. A cutter support attaches to the support plate and a cutter blade attaches to the cutter support. A balloon ribbon holder having a pair of opposing spaced-apart legs extends from the support plate, with each leg having a resilient member attached on an inward face opposing the resilient member of the opposing leg for defining a passing slot therebetween. A ribbon being dispensed longitudinally across the support plate and the cantilever in the dispensing direction overlies a neck portion of a balloon, which neck portion extends laterally stretchingly around an exterior of the cantilever and upwardly to loop (a) over the stretched portion and then (b) under the stretched portion, and being pulled longitudinally in the dispensing direction off of the cantilever to form a knot in the neck portion and which secures the ribbon in the knot. The ribbon then pulled against the cutter blade for selectively separating the ribbon from the spool and the ribbon of the ribboned knotted balloon received in the passing slot for interimly holding the ribboned knotted balloon for collecting with other ribboned knotted balloons. Having received a predetermined number of ribbons in the passing slot, a balloon bouquet is formed by removing the ribbons from the passing slot for attaching respective distal free ends of the ribbons to a weight for securing the plurality of balloons together in a bunch.

In another aspect, the present invention provides a balloon tying station for production of a balloon bouquet, comprising a rack having a plurality of spaced-apart axles each for receiving a respective spool of ribbon for selectively dispensing a ribbon longitudinally in a dispensing direction and a support plate projecting from the rack in the dispensing direction. A balloon tying device fixedly seats on the support plate extending as a cantilever therefrom, the balloon tying device further comprises a base that seats on the support plate and a brace tab extending from the support plate that abuts an edge of the support plate, and a plurality of fasteners extending through the brace tab for securing the balloon tying device to the support plate. A ribbon being dispensed longitudinally across the support plate and the cantilever in the dispensing direction underlies a neck portion of a balloon, which neck portion extends laterally stretchingly around an exterior of the cantilever and upwardly to loop (a) over the stretched portion and then (b) under the stretched portion, and being pulled longitudinally in the dispensing direction off of the cantilever to catch the ribbon and form a knot in the neck portion and which secures the ribbon in the knot.

In another aspect, the present invention provides a balloon tying station for production of a balloon bouquet, comprising a rack having a plurality of spaced-apart axles each for receiving a respective spool of ribbon for selectively dispensing a ribbon longitudinally in a dispensing direction and a support plate projecting from the rack in the dispensing direction. A balloon tying device fixedly seats on the support plate extending as a cantilever therefrom. A ribbon being dispensed longitudinally across the support plate and the cantilever in the dispensing direction underlies a neck portion of a balloon, which neck portion extends laterally stretchingly around an exterior of the cantilever and upwardly to loop (a) over the stretched portion and then (b) under the stretched portion, and being pulled longitudinally in the dispensing direction off of the cantilever to catch the ribbon and form a knot in the neck portion and which secures the ribbon in the knot. A balloon ribbon holder having a pair of opposing spaced-apart legs extends from the support plate, each leg having a resilient member attached on an inward face opposing the resilient member of the opposing leg for defining a passing slot therebetween for interimly holding a portion of the ribbon tied to the balloon received in the passing slot.

Objects, advantages, and features of the present invention are readily determined upon a reading of the following detailed description in conjunction with the drawings and the appended claims.

DETAILED DESCRIPTION

Figure 1:
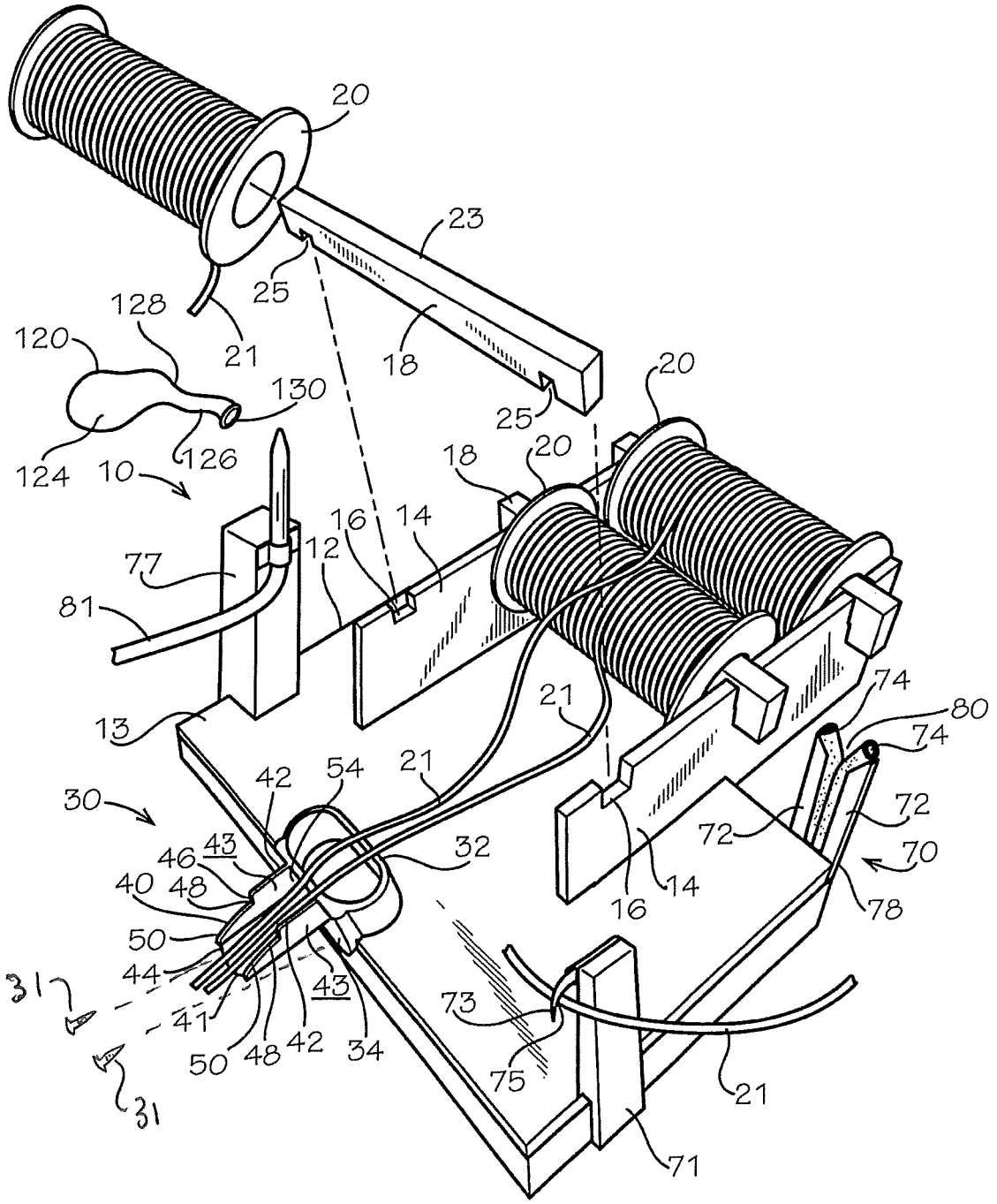
FIG. 1 illustrates in perspective partially exploded view a balloon tying station according to the present invention.

With reference to the drawings, in which like parts have like identifiers, FIG. 1 illustrates a balloon tying station 10 according to the present invention. The balloon tying station comprises a rack 12 comprising a base plate 13 and a pair of opposing walls 14 in spaced-apart relation extending from the base plate. Each wall 14 defines a plurality of spaced-apart slots 16, or recessed openings, aligned with the slots in the opposing wall. Each opposing pair of slots 16 receives an axle 18 for receiving a spool 20 of balloon ribbon 21. FIG. 1 illustrates a first axle exploded away from the walls 14 to illustrate the pair of slots 16 that receive the axle, with other axles having spools of ribbon received in the respective other pairs of slots in the walls 14. The axle 18 in the illustrated embodiment comprises an elongate member 23 having spaced slots 25 in opposing end portions. The slots 25 and the slots 16 in one of the respective pairs in the walls 14 engage lockingly. In an alternate embodiment illustrated in FIG. 5, each wall 14 comprises a first plate 22 having the slots 16 and a second plate 24 attached outwardly of the first plate 22. The second plate 24 provides a closing back for the slots 16 to restrict movement of the axles 18 outwardly of the slots during use. The axle 18 in this alternate embodiment is an elongated cylindrical member. In an alternate embodiment, the axle is a spring-biased tube having opposing telescoping members.

With continued reference to FIG. 1, the support plate 13 extends from an edge of the walls 14 in a first direction that is a dispensing direction for dispensing balloon ribbon longitudinally from a respective one of the spools 20 on one of the axles 18. A balloon tying device 30 mounts to the support plate 13 spaced from the end of the walls 14. In the illustrated embodiment, the balloon typing device 30 mounts to a distal edge portion of the support plate 13. The balloon tying device 30 assists with the formation of a knot in a neck portion of an inflated balloon, as discussed below. The balloon tying device 30 in the illustrated embodiment has a base 32 and a brace tab 34 extending perpendicularly from the base. The base 32 seats on the support plate 26 with the brace tab 34 abutting a side face of the distal edge of the support plate 13. Fasteners 31 such as screws install through openings in the brace tab 34 to secure the balloon tying device 30 to the support plate 26. The balloon tying device 30 may attach with other securing structures.

The balloon tying device 30 incudes a cantilever 40 that extends outwardly from the support plate 13. The cantilever 40 is trough-shaped generally 41 in cross-section. The cantilever 40 preferably defines an arcuate exterior surface. The cantilever 40 has two opposing upper edges 42 for opposing walls 43 and a curved exterior surface 44. The upper edges 42 terminate at a respective vertically extending retaining edge 46 that leads to a generally horizontal plateau 48. The retaining edge 46 maintains the position of a stretched portion of the neck portion of the balloon during the knot tying steps discussed below. The plateau 48 keeps the balloon tying operation sufficiently above the cantilever trough for insertion of a finger into the trough during balloon-tying operations. An arcuate or curved holding edge 50 extends from the plateau 48 to an end 52 of the cantilever 40. The arcuate or curved shape of the holding edge 50 facilitates the removal of a tied balloon by reducing the circumference of the stretched portion of the balloon about the cantilever 40 and therefore promoting the rolling-off of the tied balloon from the cantilever.

The axially oriented trough 41 or recess establishes during a balloon tying process a space 54 or opening proximate the base 32 through which a thumb and a finger of a balloon-tying operator can push and pull the neck end of a balloon in order to complete a knot in the neck portion of the balloon. The recess 54 should therefore be at least ⅝ inch wide, and preferably ¾ inch wide to fit most normal sized human fingers.

A tying end, or neck portion, of a balloon wraps on the exterior surface around the cantilever for tying a knot in the balloon as discussed below. A balloon tying device suitable for use as the balloon tying device 30 in the balloon tying station 10 is disclosed in my co-pending U.S. patent application Ser. No. 15/694,655, filed Sep. 1, 2017, incorporated herein in its entirety by reference. In an alternate embodiment, the balloon tying device comprises an elongated tying member that extends as a cantilever from the support plate, which tying member fixedly seats on the support plate. For example, the elongated member is a cylindrical member that extends as a cantilever.

Figure 2:
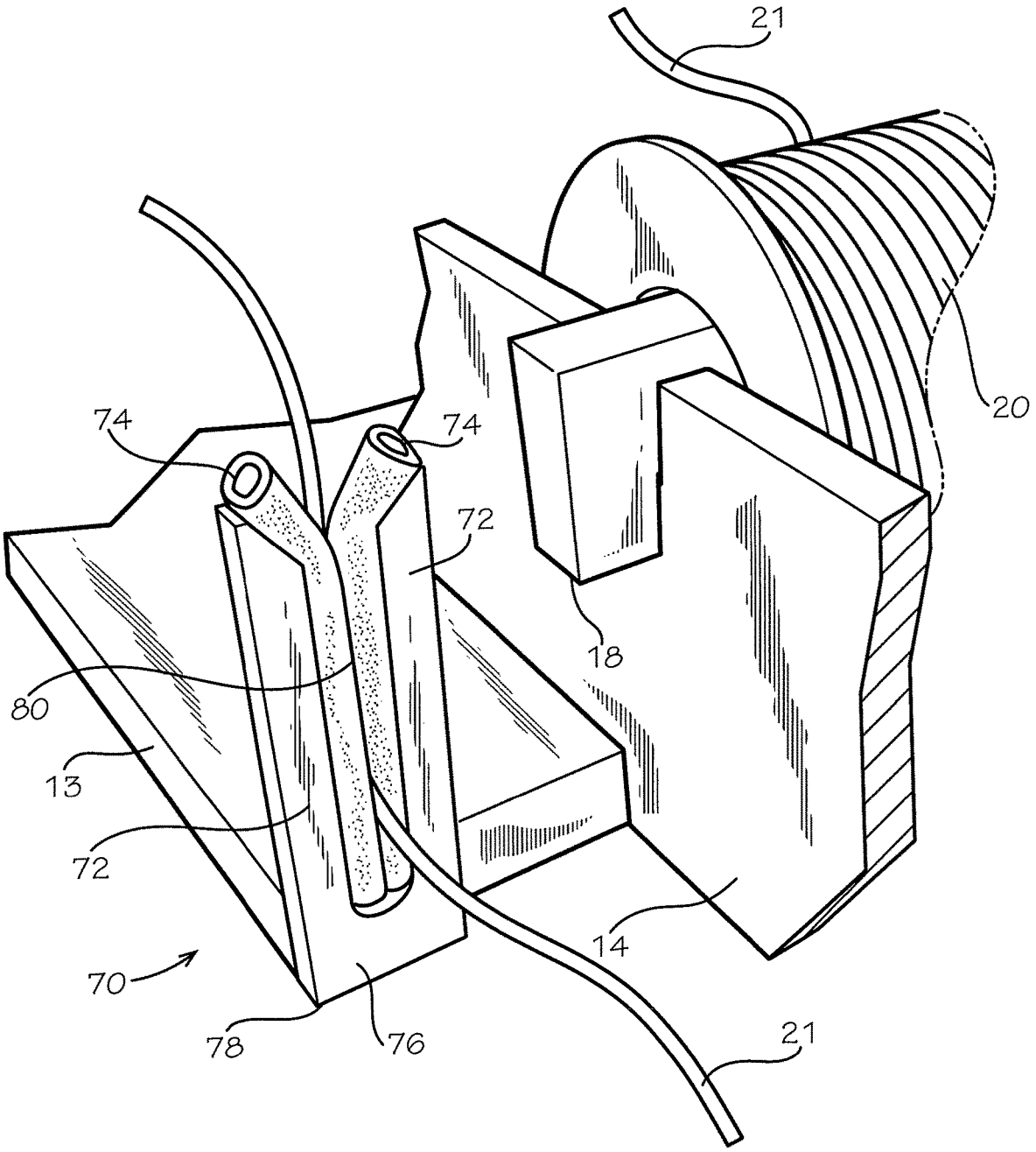
FIG. 2 illustrates a detailed perspective view of a balloon holder illustrated in FIG. 1.
Figure 6:
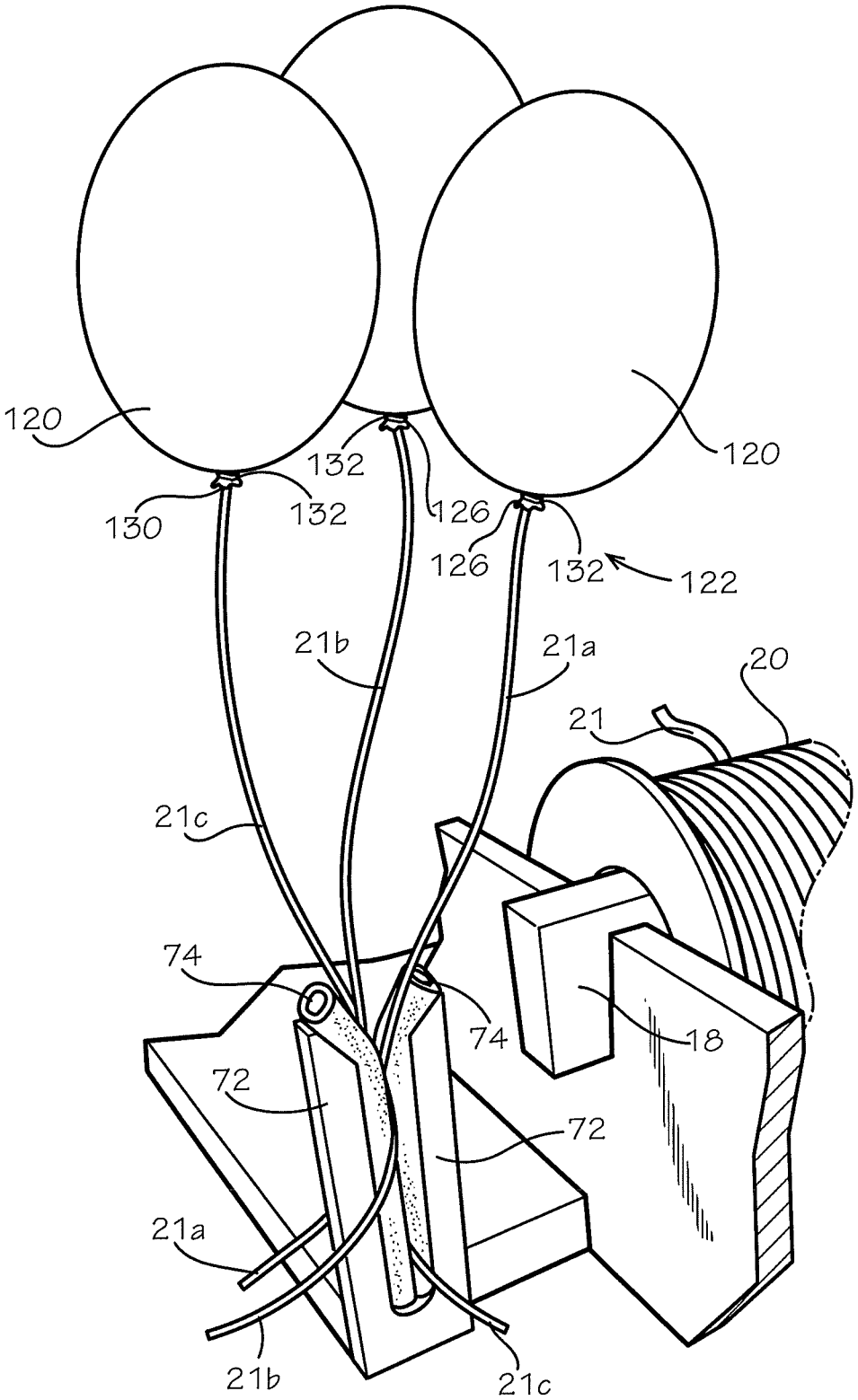
FIG. 6 illustrates in detailed perspective view the balloon holder illustrated in FIG. 1 retaining a plurality of inflated knotted ribboned balloons for gathering a balloon bouquet.

Optionally, a balloon ribbon holder 70 attaches to the balloon tying station 10 for holding a plurality of the balloon ribbons each connected to the knot of a respective inflated knotted ribboned balloon, for assembly of a group of the balloons as a balloon bouquet. The balloon ribbon holder 70 has a pair of spaced-part legs 72. Each leg 72 includes a resilient member 74 attached on a face opposing the other leg. The resilient members 74 are elongate rubber bulbs or pliable thermoplastic rubber bulbs. The resilient members attach with an adhesive on the respective leg 72 in opposing relation. As illustrated in FIG. 2, the legs 72 may extend from a base 76 to define an elongated U-shaped frame 78. Alternatively, the legs extend as separate members in spaced relation. The resilient members 74 touchingly contact and define a flexible passing slot 80 from an open end. The passing slot 80 receives a portion of the ribbon of the knotted ribboned balloon. The resilient members 74 bearing against the ribbon hold the knotted ribboned balloon proximate the balloon station 10. As additional knotted balloons are assembled with balloon ribbons using the balloon tying station, the balloon ribbon holder 70 receives the additional balloon ribbons of the subsequent knotted ribboned balloons for collecting as a group for a balloon bouquet, as illustrated in FIG. 6.

A cutter support 71 attaches to the support plate 13 lateral of but proximate to the balloon tying device 30. A cutter blade 73 attaches at a free distal end of the cutter support. The cutter blade 73 in the illustrated embodiment has a curved sharpened edge 75 for cutting the ribbon 21 at a selected portion.

An inflator support 77 attaches to the support plate 13 lateral of but proximate to the balloon tying device 30. An inflator nozzle 79 connects to a supply tube 81 that engages a gas cylinder (not illustrated), such as a helium tank, for inflating the balloons. Alternatively, the supply tube 81 connects to a supply of pressurized air, for inflating non-floating balloons such as for balloon arches. The inflator nozzle 79 has end for attaching to a mating connector on the supply tube 81, such as a threaded end sized for threading to a connector having an interior thread at the end of the supply tube 81.

In the illustrated embodiment, the inflator support 77 attaches to support plate to the left of the balloon tying device 30 while the cutter support 71 attaches to the right. This facilitates the balloon inflation, knotting and collecting process, as discussed below.

Figure 3A:
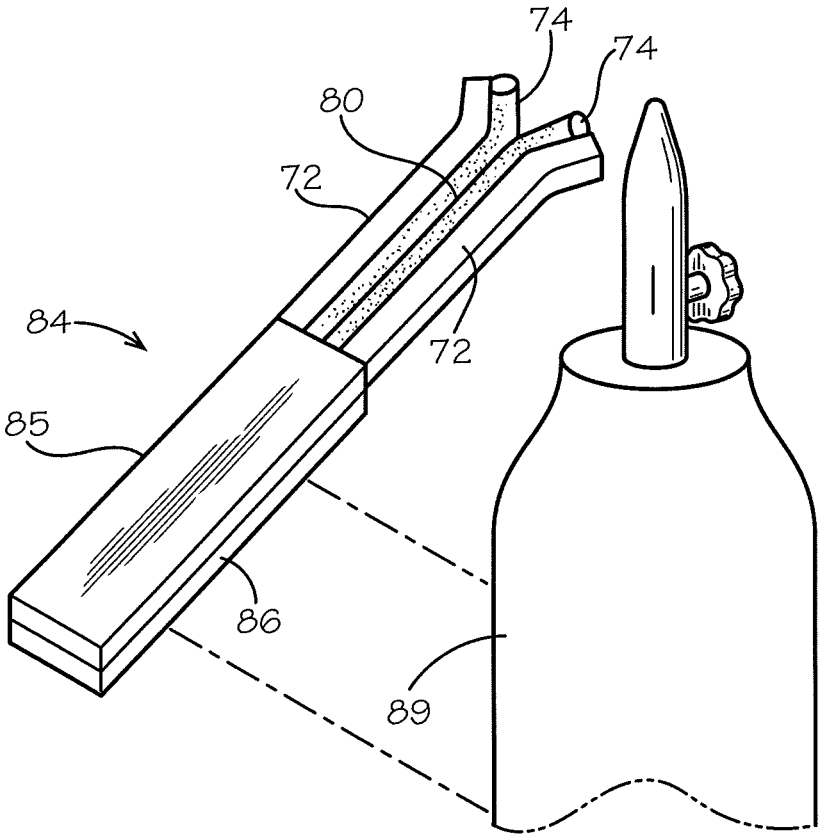
FIG. 3A illustrates in perspective view an alternate embodiment of a balloon holder.

FIG. 3A illustrates in perspective view an alternate embodiment 84 of the balloon holder 70. The balloon holder 84 includes a mounting plate 85 from which the legs 72 extend. In the illustrated embodiment the mounting plate 85 includes a magnet 86 for detachably engaging to a steel helium cylinder 89. The balloon tying operator thus may selectively position the legs 72 for receiving the ribbon of knotted ribboned balloon assembled with the balloon tying station 10. The balloon tying operator thus may selectively position the balloon holder proximate the balloon tying station 10 for receiving the ribbon 21 of knotted ribboned balloons in the passing slot 80 during the assembly process.

Figure 3B:
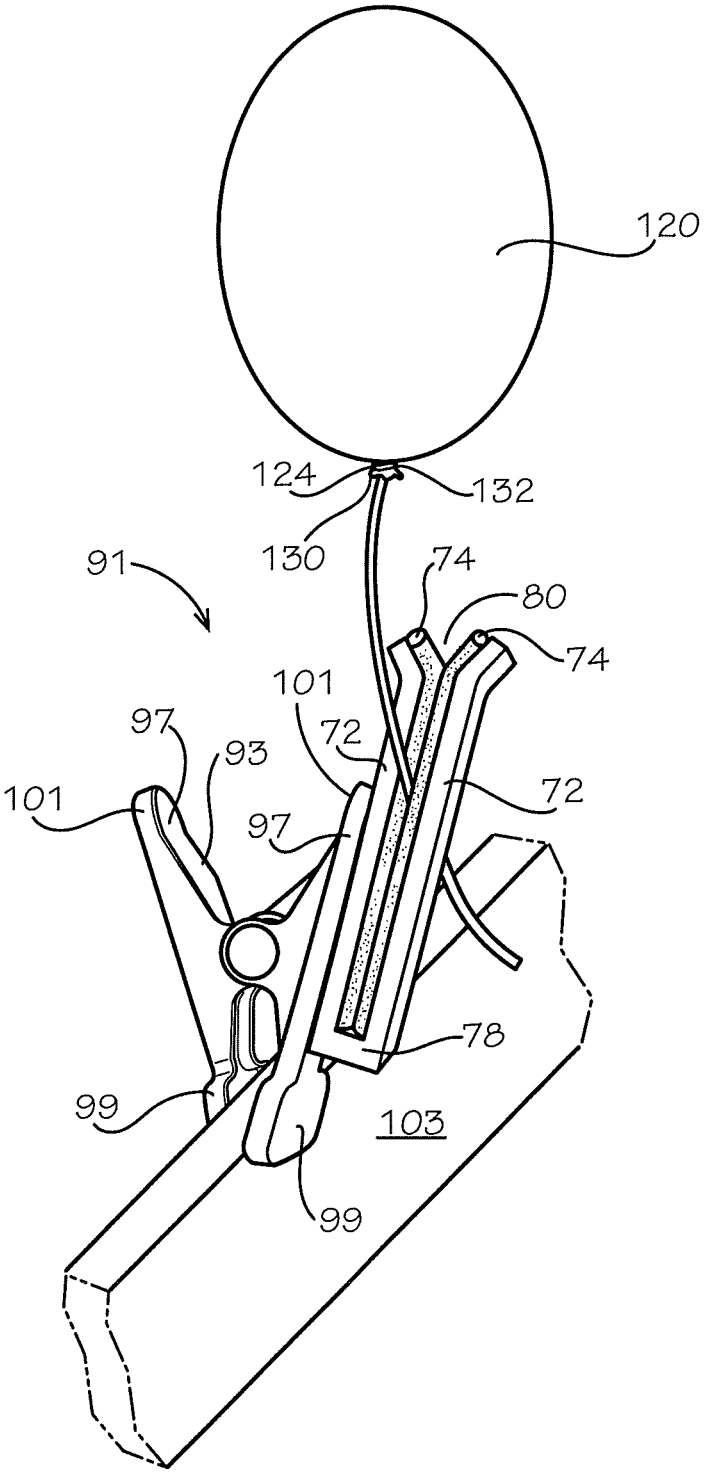
FIG. 3B illustrates in perspective view a second alternate embodiment of a balloon holder.

FIG. 3B illustrates in perspective view a second alternate embodiment of the balloon holder 91 that includes a spring-biased jaw-clip 93 for detachably engaging the balloon holder to a support (not illustrated). The jaw-clip 93 includes opposing arms 97 with opposing gripping pads 99 at a first end and a pivot arm 101 at an opposing end. The frame 78 attaches to or is integral with one of the arms 97, whereby the legs 72 and resilient members 74 extend in a first direction. A spring at an axis biases the arms 97 to a first closed position forcing the gripping pads 99 together towards the opposing pad. Applying force on the pivot arms 101 moves the gripping pads 99 apart to a second open position for clipping to a support 103. The balloon tying operator thus may selectively position the balloon holder proximate the balloon tying station 10 for receiving the ribbon 21 of knotted ribboned balloons in the passing slot 80 during the assembly process.

Figure 4:
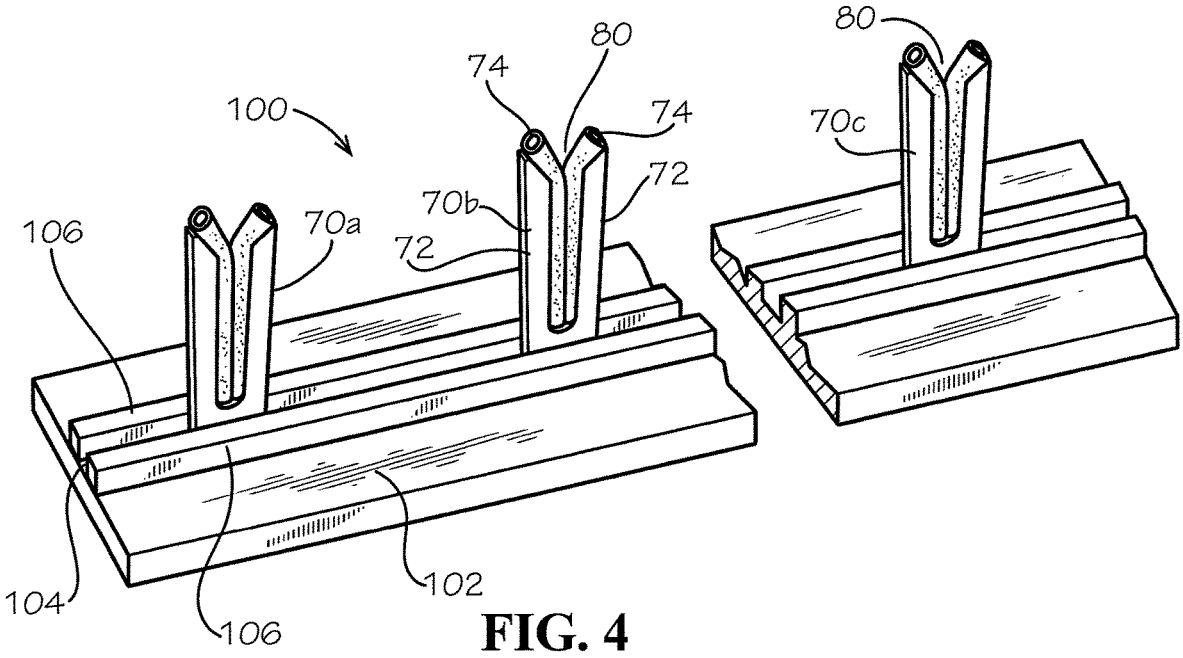
FIG. 4 illustrates in perspective view a balloon holder assembly.

FIG. 4 illustrates in perspective view a balloon holding station 100 having an elongate base 102 with a channel 104 that receives a plurality of the frames 78 of the balloon holders 70*a*, 70*b*, and 70*c* in spaced-relation. In the illustrated embodiment, a pair of spaced-apart elongate members 106 define the channel 104.

Figure 5:
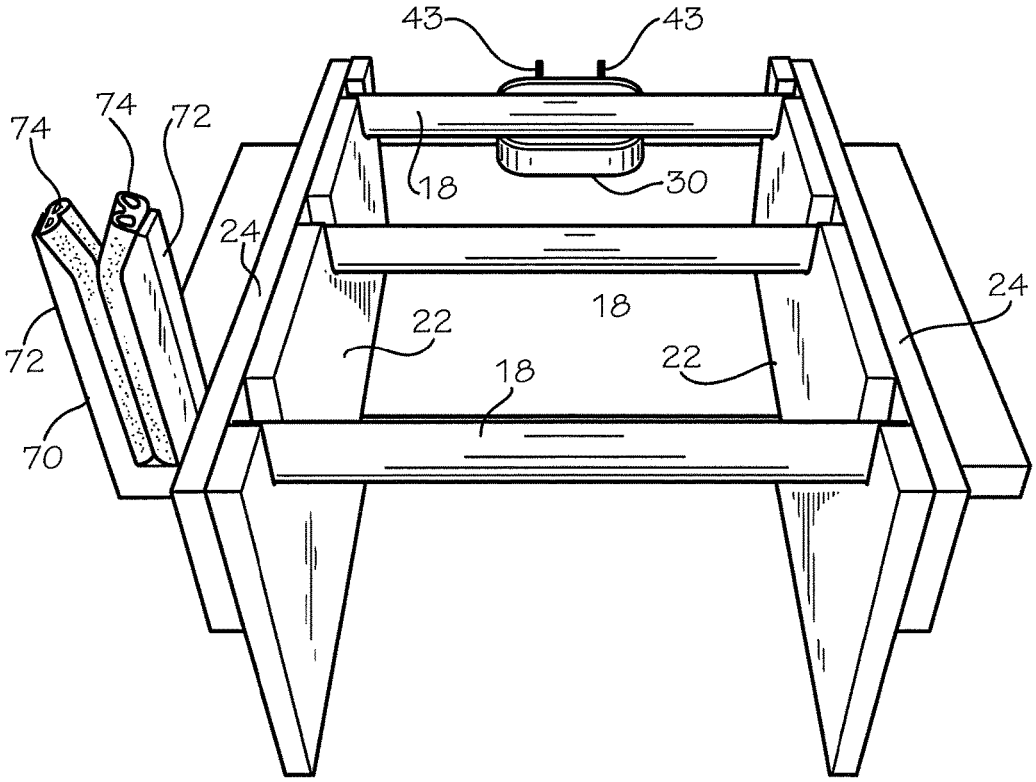
FIG. 5 illustrates an end perspective view of an alternate embodiment of a balloon tying station.

FIG. 5 illustrates an end perspective view of an alternate embodiment of a balloon tying station, as discussed above. Each wall 14 comprises the first plate 22 having the slots 16 and the second plate 24 attached outwardly of the first plate 22. The second plate 24 provides a closing back for the slots 16 to restrict movement of the axles 18 outwardly of the slots during use. The axle 18 in this alternate embodiment may preferably be an elongated cylindrical member.

FIG. 6 illustrates in detailed perspective view the balloon holder 70 illustrated in FIG. 1 retaining a plurality of inflated knotted ribboned balloons 120 for gathering a balloon bouquet generally 122. The balloon 120 has a balloon body 124 and a neck portion 126 that extends from a connecting portion 128 next to the balloon body and terminates in an open end 130. The inflated knotted ribboned balloons 120 have a knot 132 in the neck portion 126 proximate the inflator opening 130 for the balloon with a ribbon 21 secured in the knot. A distal free end portion of the respective ribbon 21*a*, 21*b*, and 21*c* seats in the passing slot 80 of the balloon holder 70, for collecting a plurality of balloons 120 for the balloon bouquet 122.

With reference to FIGS. 1 and 6, the balloon tying station 10 operates to form the knot 132 in the neck portion 126 of the inflated balloon 120 while securing an end section of the ribbon 21 in the knot, which ribbon, being cut to length, provides the knotted ribboned balloon, for use for example with other knotted ribboned balloons in a balloon bouquet 122. The axles 18 receive the respective spool 20 of ribbon and each axle seats in one of the pairs of opposing slots 16. The ribbon 21 from the spool 20 extends laterally in the dispensing direction and longitudinally along the cantilever 40 of the balloon tying device 30. Alternately, more than one ribbon may be extended along the cantilever 40 for knotted into the knot in the neck of the balloon. An alternate embodiment uses an enlongate cylindrical member, such as a pipe, around which the balloon neck is looped, with a portion held during the looping to form a passage for the leading open end to pass for forming the knot in the balloon neck.

Briefly described as to the illustrated embodiment, the balloon tying operator (an inflatist) first inflates a balloon 120 by positioning the open end 130 of the balloon neck on the inflator nozzle 79. The nozzle 79 opens for gas flow into the balloon, conventionally opening by bending the nozzle from vertical. The inflated balloon is then knotted with the knot 132 formed in the neck portion 126 using the balloon tying device 30, as discussed in detail below. The knotting steps further catch the ribbon 21 (if disposed in the trough 43 for a ribboned balloon), which ribbon is secured in the knot 132. The ribbon 21 of the knotted ribboned balloon then is positioned next to the cutter blade 73, and with a pulling motion, caused to be cut against the cutter blade 75. A distal portion of the cut ribbon then inserts into the passing slot 80 of the balloon ribbon holder 70 for collecting with other inflated knotted ribboned balloons.

More particularly described, the inflated balloon 120 (not yet knotted) is held with a thumb of a hand of a balloon tying operator bearing the connecting portion 128 of the neck portion 126 against the shoulder or the exterior of the wall 43 of the balloon tying device 30. While still pressing on the connecting portion 128, the operator pulls on the open inflation end 130 of the balloon to stretch the distal extent of the neck portion 126 of the balloon across the cantilever 40. The neck portion 126 stretches across the open trough 41 over the respective opposing plateaus 48, and wraps around the side, bottom, and opposing side of the cantilever 40 until the stretched neck portion of the balloon crosses over itself. This is discussed in my patent application Ser. No. 15/694,655.

The knot forming steps continue with the open end 130 and neck portion 126 then passed over the portion stretched between the walls 43, and then downwardly into the recess 54 of the trough 41, under the balloon neck portion stretched between the walls 43, and upwardly from the trough 41 proximate the end 52, thereby forming a half-hitch knot in the neck portion 126 around the cantilever 40. The open end 130 of the neck portion 126 is then pulled to slide the knot 94 distally off the cantilever 40 and catching the ribbon 21 which is positioned secured within the knot 132. The end 130 is rapidly pulled to tightness to complete the half-hitch knot 132 with the ribbon 21 in the knot, to seal the inflated balloon 120, hold the compressed air or gas in the balloon, and secure the ribbon in the knot. The tail or open end 130 of the balloon is pulled outwardly in a direction away from the base 32 from the cantilever 40 along a line substantially coaxial with a longitudinal axis of the cantilever. Pulling the tail pulls the stretched balloon portions along the arcuate edge and past or over the radiused portions 50 of the walls 43 of the trough 41. The ribbon 21 unwinds from the spool 20 to a selected length, and the ribbon is cut selectively to length using the cutter blade 73 as discussed above. In an alternate embodiment, two or more ribbons 21 may be knotted in the knot of the inflated balloon.

A balloon arch is readily constructed similarly. However, rather than cutting the ribbon, a second inflated balloon is attached to a selected portion of the ribbon by the tying steps discussed above. Alternatively, or in combination in an arch, a second ribbon may be pulled to length, and a distal free end tied to the inflated knotted ribbboned balloon. The balloon assembly station 10 may gainfully be used for knotting inflated balloons without the ribbon 21, for example, for collecting balloons for use in a balloon drop or ornamental arrangement of balloons that do not require floating.

The knotted ribboned balloon 90 may then be collected for grouping with other knotted ribboned balloons to form the balloon bouquet 92. In the illustrated embodiment, the ribbon of the knotted ribbboned balloon slidingly enters the passing slot 80 defined by the opposing legs 72 by the contacting resilient members 74. The passing slot 80 receives additional ribbons of knotted ribboned balloons assembled with the balloon tying station 10, for collecting as a group for a balloon bouquet.

Alternatively, with reference to FIG. 3A, the ribbon of the inflated knotted ribboned balloon may be received in the passing slot 80 of the balloon holder 84 magnetically secured by the magnet 86 to a helium tank 89 positioned proximate the balloon tying station 10, for convenient assembly of inflated floatable balloons for collecting a bunch for a balloon bouquet.

Alternatively, with reference to FIG. 3B, the ribbon of the inflated knotted ribboned balloon may be received in the passing slot 80 of the balloon holder 91 that selectively secured by the jaw-clip 93 to the support 103 positioned proximate the balloon tying station 10, for convenient assembly of inflated floatable balloons for collecting a bunch for a balloon bouquet.

Alternatively, with reference to FIG. 4, the ribbon of the inflated knotted ribboned balloon may be received in the passing slot 80 of one of the balloon holders 70 positioned spaced-apart on the balloon holding station 100.

The balloon assembly station 10 may be used for inflating and knotting non-floatable balloons, such as for collecting in a group for ornamentation uses or for balloon drops. The supply tube 81 connects to a supply of pressurized air.

The forgoing describes the present invention in various illustrative embodiments of the invention. Those skilled in the art may recognize other equivalents to the specific embodiments described herein which equivalents are intended to be encompassed by the claims attached hereto.

What is claimed is:

1. A balloon tying station for production of a balloon bouquet, comprising:

a rack having a pair of spaced apart walls, each wall comprises a first plate and a second adjacent second plate, said first plate having a plurality of spaced-apart slots and each respective slot aligned with a respective slot in the opposing first plate for receiving a respective axle in the aligned slots, said second plate attached outwardly of the first plate to restrict movement of the respective axle outwardly of the slots during use, each axle for receiving a respective spool of ribbon for selectively dispensing a ribbon longitudinally in a dispensing direction, and a support plate projecting from the rack in the dispensing direction; and a balloon tying device fixedly seated on the support plate and extending as a dished cantilever from the support plate longitudinally in the dispensing direction, whereby a ribbon being dispensed longitudinally across support plate and the cantilever in the dispensing direction underlies a neck portion of a balloon, which neck portion extends laterally stretchingly from a first edge to a second edge of the cantilever, around an exterior side, bottom and opposing side of the cantilever and upwardly to loop (a) over the stretched portion and then (b) under the stretched portion, and being pulled longitudinally in the dispensing direction off of the cantilever to catch the ribbon and form a knot in the neck portion and which secures the ribbon in the knot.

2. The balloon tying station as recited in claim 1, wherein the balloon tying device further comprises a base that seats on the support plate and a brace tab extending from the base that abuts an edge of the support plate, and a plurality of fasteners extending through the brace tab for securing the balloon tying device to the support plate.

3. The balloon tying station as recited in claim 1, further comprising a balloon ribbon holder having a pair of opposing spaced-apart legs extending from the support plate, each leg having a resilient member attached on an inward face opposing the resilient member of the opposing leg for defining a passing slot therebetween for interimly holding a portion of the ribbon tied to the balloon received in the passing slot.

4. The balloon tying station as recited in claim 3, wherein the legs are spaced such that an outward edge of the resilient member is in contact with the opposing resilient member for grippingly holding the portion of the ribbon therebetween.

5. The balloon tying station as recited in claim 3, wherein the passing slot receives a plurality of ribbons therein.

6. The balloon tying station as recited in claim 5, whereupon having received a predetermined number of ribbons in the passing slot, a balloon bouquet is formed by removing the ribbons from the passing slot for attaching respective distal free ends of the ribbons to a weight for securing the plurality of balloons together in a bunch.

7. The balloon tying station as recited in claim 1, further comprising:

a cutter support attached to the support plate; and a cutter blade attached to the cutter support.

8. The balloon tying station as recited in claim 1, further comprising:

an inflator support attached to the support plate; and a nozzle mounted to the inflator support and connected to a supply of inflator gas, whereby the nozzle, receiving a neck portion of a balloon, selectively opens for communicating gas from the supply into the balloon for inflation thereof.

9. A balloon tying station for production of a balloon bouquet, comprising:

a rack having a plurality of spaced-apart axles each for receiving a respective spool of ribbon for selectively dispensing a ribbon longitudinally in a dispensing direction and a support plate projecting from the rack in the dispensing direction;

a balloon tying device fixedly seated on the support plate and having an elongated dished cantilever extending therefrom, the cantilever defining opposing side walls that each have arcuate distal end portions;

a cutter support attached to the support plate; and a cutter blade attached to the cutter support; and a balloon ribbon holder having a pair of opposing spaced-apart legs extending from the support plate, each leg having a resilient member attached on an inward face opposing the resilient member of the opposing leg for defining a passing slot therebetween, whereby a ribbon being dispensed longitudinally across the support plate and the cantilever in the dispensing direction overlies a neck portion of a balloon, which neck portion extends laterally stretchingly around an exterior of the cantilever and upwardly to loop (a) over the stretched portion and then (b) under the stretched portion, and being pulled longitudinally in the dispensing direction off of the cantilever to form a knot in the neck portion and which secures the ribbon in the knot, the ribbon then pulled against the cutter blade for selectively separating the ribbon from the spool, and the ribbon of the ribboned knotted balloon received in the passing slot for interimly holding the ribboned knotted balloon for collecting with other ribboned knotted balloons, whereupon having received a predetermined number of ribbons in the passing slot, a balloon bouquet is formed by removing the ribbons from the passing slot for attaching respective distal free ends of the ribbons to a weight for securing the plurality of balloons together in a bunch.

10. The balloon tying station as recited in claim 9, further comprising:

an inflator support attached to the support plate; and a nozzle mounted to the inflator support and connected to a supply of inflator gas, whereby the nozzle, receiving a neck portion of a balloon, selectively opens for communicating gas from the supply into the balloon for inflation thereof.

11. A balloon tying station for production of a balloon bouquet, comprising:

a rack having a plurality of spaced-apart axles each for receiving a respective spool of ribbon for selectively dispensing a ribbon longitudinally in a dispensing direction and a support plate projecting from the rack in the dispensing direction; and a balloon tying device fixedly seated on the support plate extending as a cantilever therefrom, the balloon tying device further comprises a base that seats on the support plate and a brace tab extending from the support plate that abuts an edge of the support plate, and a plurality of fasteners extending through the brace tab for securing the balloon tying device to the support plate, whereby a ribbon being dispensed longitudinally across the support plate and the cantilever in the dispensing direction underlies a neck portion of a balloon, which neck portion extends laterally stretchingly around an exterior of the cantilever and upwardly to loop (a) over the stretched portion and then (b) under the stretched portion, and being pulled longitudinally in the dispensing direction off of the cantilever to catch the ribbon and form a knot in the neck portion and which secures the ribbon in the knot.

12. The balloon tying station as recited in claim 11, wherein the cantilever is a dished cantilever extending from support plate longitudinally in the dispensing direction.

13. The balloon tying station as recited in claim 11, further comprising a balloon ribbon holder having a pair of opposing spaced-apart legs extending from the support plate, each leg having a resilient member attached on an inward face opposing the resilient member of the opposing leg for defining a passing slot therebetween for grippingly holding a portion of the ribbon tied to the balloon received in the passing slot.

14. The balloon tying station as recited in claim 13, whereupon having received a predetermined number of ribbons in the passing slot, a balloon bouquet is formed by removing the ribbons from the passing slot for attaching respective distal free ends of the ribbons to a weight for securing the plurality of balloons together in a bunch.

15. The balloon tying station as recited in claim 11, further comprising:

a cutter support attached to the support plate; and a cutter blade attached to the cutter support.

16. The balloon tying station as recited in claim 11, further comprising:

an inflator support attached to the support plate; and a nozzle mounted to the inflator support and connected to a supply of inflator gas, whereby the nozzle, receiving a neck portion of a balloon, selectively opens for communicating gas from the supply into the balloon for inflation thereof.

17. A balloon tying station for production of a balloon bouquet, comprising:

a rack having a plurality of spaced-apart axles each for receiving a respective spool of ribbon for selectively dispensing a ribbon longitudinally in a dispensing direction and a support plate projecting from the rack in the dispensing direction;

a balloon tying device fixedly seated on the support plate extending as a cantilever therefrom, whereby a ribbon being dispensed longitudinally across the support plate and the cantilever in the dispensing direction underlies a neck portion of a balloon, which neck portion extends laterally stretchingly around an exterior of the cantilever and upwardly to loop (a) over the stretched portion and then (b) under the stretched portion, and being pulled longitudinally in the dispensing direction off of the cantilever to catch the ribbon and form a knot in the neck portion and which secures the ribbon in the knot; and a balloon ribbon holder having a pair of opposing spaced-apart legs extending from the support plate, each leg having a resilient member attached on an inward face opposing the resilient member of the opposing leg for defining a passing slot therebetween for interimly holding a portion of the ribbon tied to the balloon received in the passing slot.

18. The balloon tying station as recited in claim 17, whereupon having received a predetermined number of ribbons in the passing slot, a balloon bouquet is formed by removing the ribbons from the passing slot for attaching respective distal free ends of the ribbons to a weight for securing the plurality of balloons together in a bunch.

19. The balloon tying station as recited in claim 17, further comprising:

a cutter support attached to the support plate; and a cutter blade attached to the cutter support.

20. The balloon tying station as recited in claim 17, further comprising:

an inflator support attached to the support plate; and a nozzle mounted to the inflator support and connected to a supply of inflator gas, whereby the nozzle, receiving a neck portion of a balloon, selectively opens for communicating gas from the supply into the balloon for inflation thereof.

* * * * *